US007135636B2

(12) United States Patent
Kemmochi et al.

(10) Patent No.: US 7,135,636 B2
(45) Date of Patent: Nov. 14, 2006

(54) SINGING VOICE SYNTHESIZING APPARATUS, SINGING VOICE SYNTHESIZING METHOD AND PROGRAM FOR SINGING VOICE SYNTHESIZING

(75) Inventors: Hideki Kemmochi, Shimizu (JP); Yasuo Yoshioka, Hamamatsu (JP); Jordi Bonada, Barcelona (ES)

(73) Assignee: Yamaha Corporation, Hamamatsu (JP)

( * ) Notice: Subject to any disclaimer, the term of this patent is extended or adjusted under 35 U.S.C. 154(b) by 249 days.

(21) Appl. No.: 10/375,272

(22) Filed: Feb. 27, 2003

(65) Prior Publication Data

US 2003/0159568 A1 Aug. 28, 2003

(30) Foreign Application Priority Data

Feb. 28, 2002 (JP) ..... 2002-054487

(51) Int. Cl.
*G10H 1/06* (2006.01)
*G10H 7/00* (2006.01)

(52) U.S. Cl. ..... 84/622; 84/609; 84/615; 84/627; 84/649; 84/653; 84/659

(58) Field of Classification Search ..... 84/600–602, 84/609, 615–616, 622–625, 627, 649, 653–654, 84/659–660, 663; 704/200, 205, 207–209, 704/251

See application file for complete search history.

(56) References Cited

U.S. PATENT DOCUMENTS 5,536,902 A 7/1996 Serra
5,703,311 A * 12/1997 Ohta ..... 84/622
5,704,006 A * 12/1997 Iwahashi ..... 704/259
5,895,449 A * 4/1999 Nakajima et al. ..... 704/278
5,998,725 A * 12/1999 Ohta ..... 84/627
2003/0009336 A1* 1/2003 Kenmochi et al. ..... 704/258
2003/0009344 A1* 1/2003 Kayama et al. ..... 704/500
2004/0006472 A1* 1/2004 Kemmochi ..... 704/269

FOREIGN PATENT DOCUMENTS

EP 1220195 * 7/2002

(Continued)

OTHER PUBLICATIONS

Journal of Acoustical Science and Technology, The Acoustical Society of Japan, Dec. 1, 1993, vol. 49, No. 12, pp/ 847-853.

(Continued)

*Primary Examiner*—Marlon Fletcher
(74) *Attorney, Agent, or Firm*—Pillsbury Winthrop Shaw Pittman LLP

(57) ABSTRACT

A method for synthesizing a natural-sounding singing voice divides performance data into a transition part and a long sound part. The transition part is represented by articulation (phonemic chain) data that is read from an articulation template database and is outputted without modification. For the long sound part, a new characteristic parameter is generated by linearly interpolating characteristic parameters of the transition parts positioned before and after the long sound part and adding thereto a changing component of stationary data that is read from a constant part (stationary) template database. An associated apparatus for carrying out the singing voice synthesizing method includes a phoneme database for storing articulation data for the transition part and stationary data for the long sound part, a first device for outputting the articulation data, and a second device for outputting the newly-generated characteristic parameter of the long sound part.

21 Claims, 14 Drawing Sheets

FOREIGN PATENT DOCUMENTS

| | | |
|---|---|---|
| JP | 05-006168 | 1/1993 |
| JP | 10-240264 | 9/1997 |
| JP | 11-184490 | 12/1997 |
| JP | 2002-268659 | 9/2002 |

OTHER PUBLICATIONS

Japanese Official Office Action dated Feb. 14, 2006.

* cited by examiner

FIG.1C

ARTICULATION DATA

| FIRST PHONEME NAME | FOLLOW-ING PHONEME NAME | HARMONIC COMPONENT (CHARACTERISTIC PARAMETER CHAIN) | STOCHASTIC COMPONENT (SPECTRUM CHAIN) |
|---|---|---|---|
| # | s | | |
| s | a | | |
| a | i | | |
| i | t | | |
| t | a | | |

.....

STATIONARY DATA

| PHONEME | HARMONIC COMPONENT (CHARACTERISTIC PARAMETER CHAIN) | STOCHASTIC COMPONENT (SPECTRUM CHAIN) |
|---|---|---|
| a | | |
| i | | |

.....

FIG.6C

ARTICULATION DATA

PITCH1

| FIRST PHONEME NAME | FOLLOW-ING PHONEME NAME | HARMONIC COMPONENT (CHARACTERISTIC PARAMETER CHAIN) | STOCHASTIC COMPONENT (SPECTRUM CHAIN) |
|---|---|---|---|
| # | s | | |
| s | a | | |
| a | i | | |
| i | t | | |
| t | a | | |

.....

STATIONARY DATA

PITCH1

| PHONEME | HARMONIC COMPONENT (CHARACTERISTIC PARAMETER CHAIN) | STOCHASTIC COMPONENT (SPECTRUM CHAIN) |
|---|---|---|
| a | | |
| i | | |

.....

SINGING VOICE SYNTHESIZING APPARATUS, SINGING VOICE SYNTHESIZING METHOD AND PROGRAM FOR SINGING VOICE SYNTHESIZING

CROSS REFERENCE TO RELATED APPLICATION

This application is based on Japanese Patent Application 2002-054487, filed on Feb. 28, 2002 the entire contents of which are incorporated herein by reference.

BACKGROUND OF THE INVENTION

A) Field of the Invention

This invention relates to a singing voice synthesizing apparatus, a singing voice synthesizing method and a program for singing voice synthesizing for synthesizing a human singing voice.

B) Description of the Related Art

In a conventional singing voice synthesizing apparatus, data obtained from an actual human singing voice is stored as a database, and data that agrees with contents of an input performance data (a musical note, a lyrics, an expression and the like) is chosen from the database. Then, a singing voice that is close to the real human singing voice is synthesized by a data conversion of this performance data based on the chosen data.

A principle of the singing voice synthesizing is explained in Japanese Patent Application No.2001-67258, which was filed by the applicant of the present invention, with reference to FIGS. 7 and 8.

The principle of the singing voice synthesizing apparatus mentioned by Japanese Patent Application No.2001-67258 is shown in FIG. 7. This singing voice synthesizing apparatus equips a timbre template database 51 in which data for characteristic parameters of phoneme (timbre template) at one point is stored, a constant part (stationary) template database 53 in which data (the stationary template) for slight change of the characteristic parameters in a long sound is stored and a phonemic chain (articulation) template database 52 in which data (the articulation template) that change from a phoneme to a phoneme for the characteristic parameters of the transition part is shown.

The characteristic parameter is generated by applying these templates by doing as follows.

That is, synthesizing of the long sound part is executed by adding changing component included in the stationary template on the characteristic parameter obtained from the timbre template.

On the other hand, however, synthesizing of the transition part is executed by adding the changing component included in the articulation template on the characteristic parameter obtained from the timbre template, a characteristic parameter to be added with is different by cases. For example, in a case that a front and a rear phonemes of the transition part are both voiced sounds, the changing component included in the articulation template on the characteristic parameter is added on what is obtained by linear interpolation of the characteristic parameter of the front part phoneme and the characteristic parameter of the rear part phoneme. Also, in a case that the front part phoneme is a voiced sound and the rear part phoneme is a silence, the changing component included in the articulation template on the characteristic parameter is added on the characteristic parameter of the front part phoneme. Also, in a case that the front part phoneme is a silence and the rear part phoneme is a voiced sound, the changing component included in the articulation template-on the characteristic parameter is added on the characteristic parameter of the rear part phoneme. As doing as the above, in the singing voice synthesizing apparatus disclosed in Japanese Patent Application No.2001-67258, the characteristic parameter generated from the timbre template is a standard, and singing voice synthesizing is executed by change of the characteristic parameter of the articulation part so that it is agreed with the characteristic parameter of this timbre part.

In the singing voice synthesizing apparatus disclosed in Japanese Patent Application No.2001-67258, there were cases that the singing voice to be synthesized was unnatural. The causes for that are the followings:

a change in the characteristic parameter of the transition part is different from a change in that if original transition part because the change of the articulation template is changed; and a phoneme before a long sound part is always same regardless of a kind of the phoneme because the characteristic parameter of the long sound part is also calculated from the addition of the characteristic parameter generated from the timbre template with the changing component of the stationary template.

That is, in the singing voice synthesizing apparatus disclosed in Japanese Patent Application No.2001-67258, there were cases that the synthesized singing voice was unnatural because the parameter of the long sound and the transition part has been added based on the characteristic parameter of the timbre template that is just a part of whole singing song.

For example, in the conventional singing voice synthesizing apparatus, in a case of making a singer sing "saita", phonemes between phonemes do not transit naturally, and the singing voice to be synthesized has an unnatural audio sound. Also, there is a case that it cannot be judged what the synthesized singing voice is singing.

That is, in the singing voice, for example, in a case of singing "saita", it is pronounced without partitions of each phoneme ("sa", "i" and "ta"), and it is normally pronounced by inserting a long sound part and a transition part between each phoneme as "[#s] sa (a), [ai], i, (i), [it], ta, (a) ("#" represents a silence). In this case of the example of "saita", [#s], [ai] and [it] are the transition parts, and (a), (i) and (a) are the long sounds. Therefore, in a case that a singing voice is synthesized from performance data such as MIDI information, it is significant how realistically the transition part and the long sound part are generated.

SUMMARY OF THE INVENTION

It is an object of the present invention to provide a singing voice synthesizing apparatus that can naturally reproduce a transition part.

According to the present invention, high naturality of a synthesized singing voice of the transition part can be kept.

According to one aspect of the present invention, there is provided a singing voice synthesizing apparatus, comprising: a storage device that stores singing voice information for synthesizing a singing voice; a phoneme database that stores articulation data of a transition part that includes an articulation for a transition from one phoneme to another phoneme and stationary data of a long sound part that includes stationary part where one phoneme is stably pronounced; a selecting device that selects data stored in the phoneme database in accordance with the singing voice information; a first outputting device that outputs a characteristic parameter of the transition part by extracting the characteristic parameter of the transition part from the articulation data selected by the selecting device, and a second outputting device that obtains the articulation data before and after the stationary data of a long sound part selected by the selecting device, generates a characteristic parameter of the long sound part by interpolating the obtained two articulation data and outputs the generated characteristic parameter of the long sound part.

According to another aspect of the present invention, there is provided a singing voice synthesizing method, comprising the steps of: (a) storing articulation data of a transition part that includes an articulation for a transition from one phoneme to another phoneme and stationary data of a long sound part that includes stationary part where one phoneme is stably pronounced into a phoneme database; (b) inputting singing voice information for synthesizing a singing voice; (c) selecting data stored in the phoneme database in accordance with the singing voice information; (d) outputting a characteristic parameter of the transition part by extracting the characteristic parameter of the transition part from the articulation data selected by the step (c); and (e) obtaining the articulation data before and after the stationary data of a long sound part selected by the selecting device, generating a characteristic parameter of the long sound part by interpolating the obtained two articulation data and outputting the generated characteristic parameter of the long sound part.

According to the present invention, only the articulation template database 52 and the stationary template database 53 are used, and the timbre template is basically not necessary.

After dividing the performance data into the transition part and the long sound part, the articulation template is used without change in the transition part. Therefore, singing voice of the transition parts that are significant parts of the song sounds natural, and quality of the synthesized singing voice will be high.

Also, as for the long sound part, the characteristic parameter of the transition parts of both ends of the long sound is executed linear interpolation, and a characteristic parameter is generated by adding the changing component included in the stationary template on the interpolated characteristic parameter. The singing voice will not be unnatural because of interpolation based on data without change of the template.

BRIEF DESCRIPTION OF THE DRAWINGS

FIGS. 1A to 1C are a functional block diagram of a singing voice synthesizing apparatus and an example of phoneme database according to a first embodiment of the present invention.

FIGS. 6A to 6C are a functional block diagram of the singing voice synthesizing apparatus and an example of phoneme database according to a third embodiment of the present invention.

DETAILED DESCRIPTION OF THE PREFERRED EMBODIMENTS

Figure 1A:
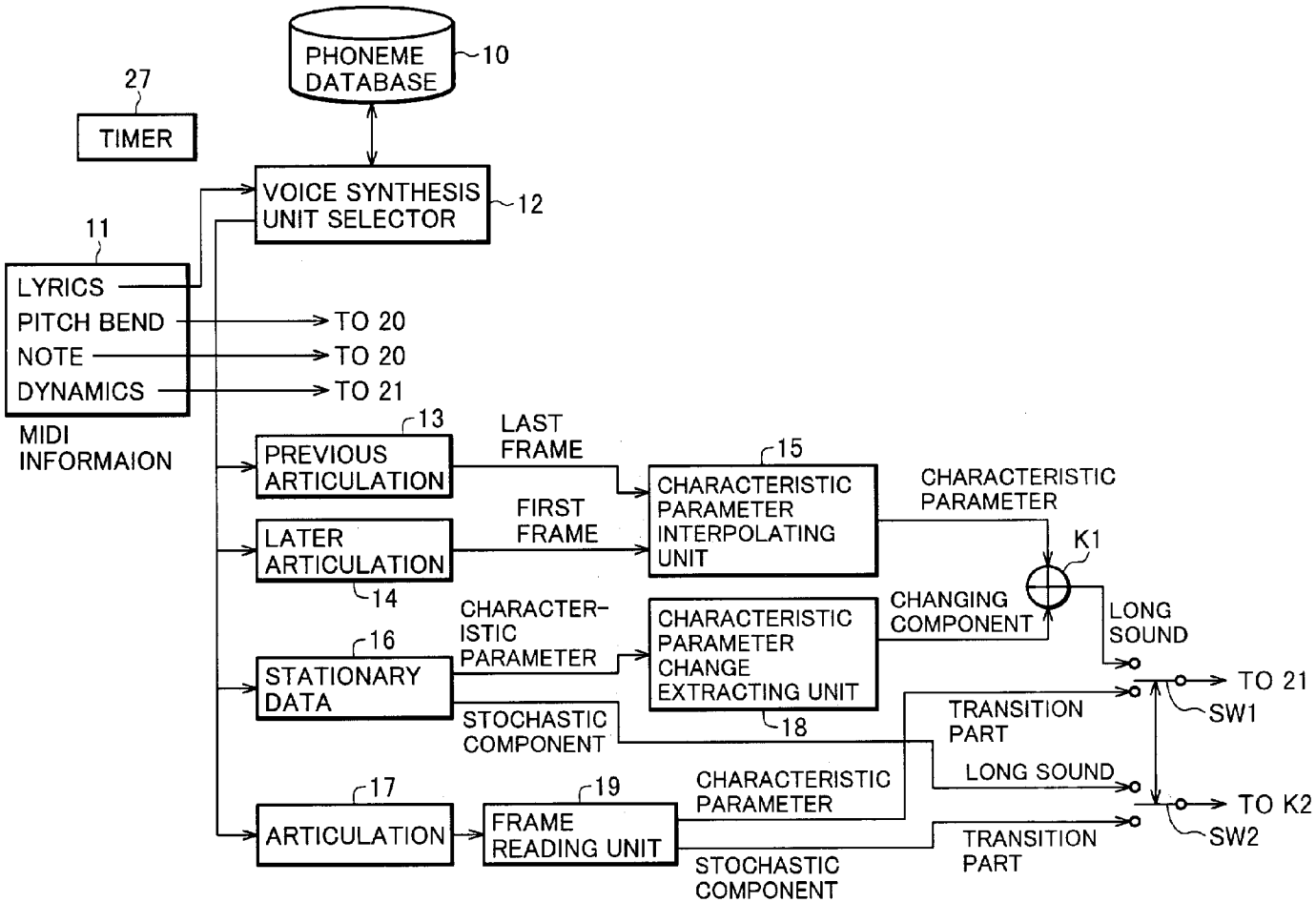
Figure 1B:
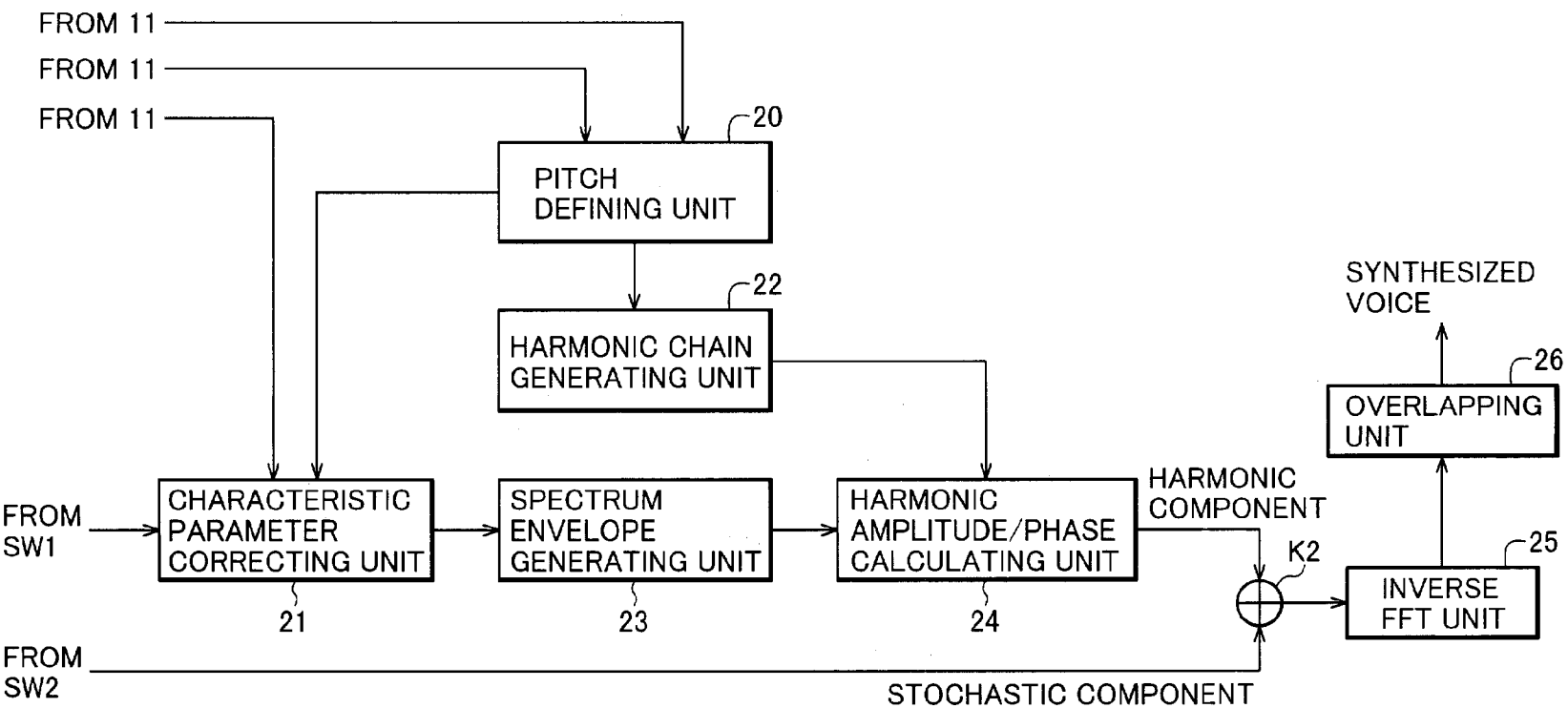

FIGS. 1A to 1C (hereinafter just called FIG. 1) are a functional block diagram of a singing voice synthesizing apparatus and an example of phoneme database according to a first embodiment of the present invention. The singing voice synthesizing apparatus is, for example, realized by a general personal computer, and functions of each block shown in FIG. 1 can be accomplished by a CPU, a RAM and a ROM in the personal computer. It can be constructed also by a DSP and a logical circuit. A phonemic database 10 has data for synthesizing a synthesized voice based on a performance data. FIG. 1C shows an example of this phonemic database 10 that is later explained with reference to FIG. 2.

Figure 2A:
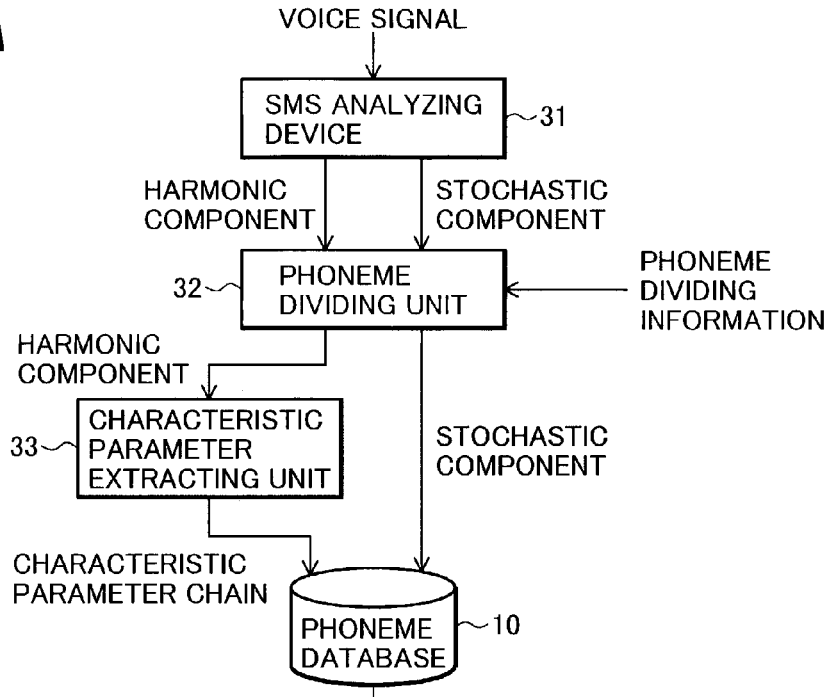
FIGS. 2A and 2B show an example of a phoneme database 10 shown in FIG. 1.

As shown in FIG. 2A, a voice signal such as singing song data and the like that is actually recorded or obtained is separated into a deterministic component (a sine wave component) and a stochastic component by a spectral modeling synthesis (SMS) analyzing device 31. Other analyzing methods such as a linear predictive coding (LPC) and the like can be used instead of the SMS analysis.

Next, the voice signal is divided by phonemes by a phoneme dividing unit 32 based on phoneme dividing information. For example, phoneme dividing information is normally input by a human operation of a predetermined switch with reference to a waveform of a voice signal.

Then, a characteristic parameter is extracted from the deterministic component of the voice signal divided by phonemes by a characteristic parameter extracting unit 33. The characteristic parameter includes an excitation waveform envelope, a formant frequency, a formant width, formant intensity, a spectrum of difference and the like.

The excitation waveform envelope (excitation curve) is consisted of an Egain that represents a magnitude of a vocal cord waveform (dB), an EslopeDepth that represents slope for the spectrum envelope of the vocal tract waveform, and an Eslope that represents depth from a maximum value to a minimum value for the spectrum envelope of the vocal cord vibration waveform (dB). ExcitationCurve can be expressed by the following equation (A):

$$\text{ExcitationCurve}(f)=\text{EGain}+\text{ESlopeDepth}*(\exp(-\text{ESlope}*f)-1) \quad \text{(A)}$$

The excitation resonance represents chest resonance. It is consisted of three parameters: a central frequency (ERFreq), a band width (ERBW) and an amplitude (ERAmp), and has a secondary filtering character.

The formant represents a vocal tract resonance by combining 1 to 12 resonances. It is consisted of three parameters: a central frequency (Formant Freqi, i is an integral number from 1 to 12), a band width (FormantBWi, i is an integral number from 1 to 12) and an amplitude (FormantAmpi, i is an integral number from 1 to 12).

The differential spectrum is a characteristic parameter that has a differential spectrum from an original deterministic component that cannot be expressed by the above three: the excitation waveform envelope, the excitation resonance and the formant.

Figure 2B:
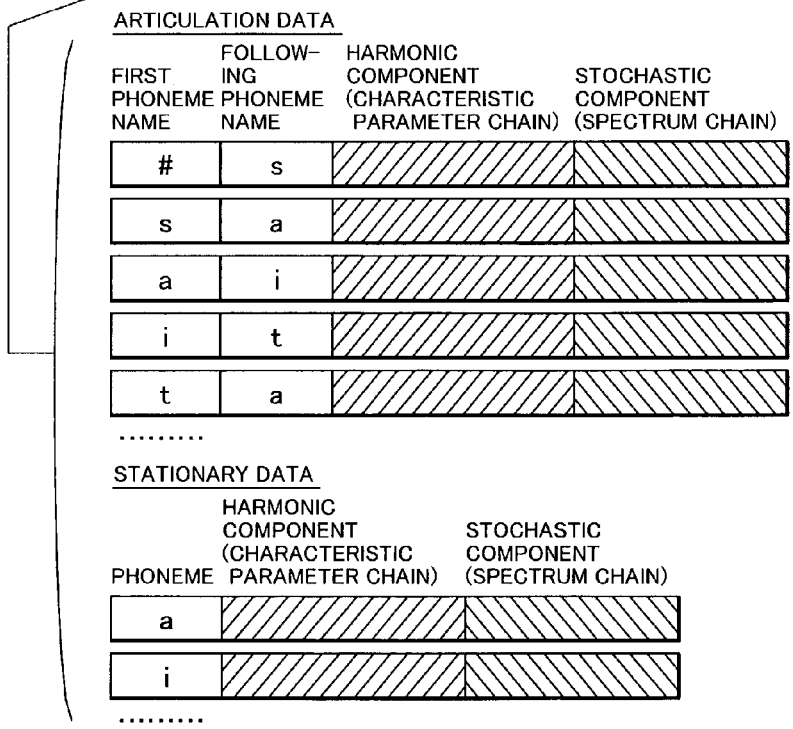

This characteristic parameter is stored in a phoneme database 10 corresponding to a name of phoneme. The stochastic component is also stored in the phoneme database 10 corresponding to the name of phoneme. In this phoneme database 10, they are divided into articulation (phonemic chain) data and stationary data to be stored as shown in FIG. 2B. Hereinafter, "voice synthesis unit data" is a general term for the articulation data and the stationary data.

The voice synthesis data is a chain of data corresponding to a first phoneme name, a following phoneme name, the characteristic parameter and the stochastic component.

On the other hand, the stationary data is a chain of data corresponding to one phoneme name, a chain of the characteristic parameters and the stochastic component.

Back to FIG. 1, a unit 11 is a performance data storage unit for storing the performance data. The performance data is, for example, MIDI information that includes information such as a musical note, lyrics, a pitch bend, dynamics, etc.

A voice synthesis unit selector 12 accepts an input of performance data kept in the performance data storage unit 11 in a unit of a frame (hereinafter the unit are called the frame data), and reads voice synthesis unit data corresponding to lyrics data included in the input performance data by selecting it from the phoneme database 10.

A previous articulation data storage unit 13 and a later articulation data storage unit 14 are used for storing stationary data. The previous articulation data storage unit 13 stores previous articulation data of stationary data to be processed. On the other hand, the later articulation data storage unit 14 stores later articulation data of stationary data to be processed.

A characteristic parameter interpolation unit 15 reads a parameter of a last frame of the articulation data stored in the previous articulation data storage unit 13 and a characteristic parameter of a first frame of the articulation data stored in the later articulation data storage unit 14, and interpolates the characteristic parameters in a time sequence to be corresponding to a time directed by the timer 27.

A stationary data storage unit 16 temporarily stored stationary data from voice synthesis data read by the voice synthesis unit selector 12. On the other hand, an articulation data storage unit 17 temporarily stored articulation data.

A characteristic parameter change detecting unit 18 reads stationary data stored in the stationary data storage unit 16 to extract a change (throb) of the characteristic parameter, and it has a function to output as a change component.

An adding unit K1 is a unit to output deterministic component data of the long sound by adding output of the characteristic parameter interpolation unit 15 and output of the characteristic parameter change detecting unit 18.

A frame reading unit 19 reads articulation data stored in the articulation data storage unit 17 as frame data in accordance with a time indicated by a timer 27, and divides into a characteristic parameter and a stochastic component to output.

A pitch defining unit 20 defines a pitch of a synthesized voice to be synthesized finally based on musical note data in frame data. Also, a characteristic parameter correction unit 21 interpolates a characteristic parameter of a long sound output from the adding unit K1 and a characteristic parameter of a transition part output from the frame reading unit 19 based on dynamics information that is included in performance data. In the preceding part of the characteristic parameter correction unit 21, a switch SW1 is provided, and the characteristic parameter of the long sound and the characteristic parameter of the transition part are input in the characteristic correction unit. Details of a process in this characteristic parameter correction unit 21 are explained later. A switch SW2 switches the stochastic component of the long sound read from the stationary data storage unit 16 and the stochastic component of the transition part read from the frame reading unit 19 to output.

A harmonic chain generating unit 22 generates a harmonic chain for formant synthesizing on a frequency axis in accordance with a determined pitch.

A spectrum envelope generating unit 23 generates a spectrum envelope in accordance with a characteristic parameter that is interpolated in the characteristic parameter correction unit 21.

A harmonics amplitude/phase calculating unit 24 calculates an amplitude or a phase of each harmonics generated in the harmonic chain generating unit 22 in accordance with the spectrum envelope generated in the spectrum envelope generating unit 23.

An adding unit K2 adds a deterministic component as output of the harmonics amplitude/phase calculating unit 24 and a stochastic component output from the switch SW2.

An inverse FFT unit 25 converts a signal in a frequency expression into a signal in a time sequential expression by the inverse fast Fourier transformation (IFFT) of output value of the adding unit K2.

An overlapping unit 26 outputs a synthesized singing voice by overlapping signals obtained one after another from lyrics data processed in a time sequential order.

Figure 3:
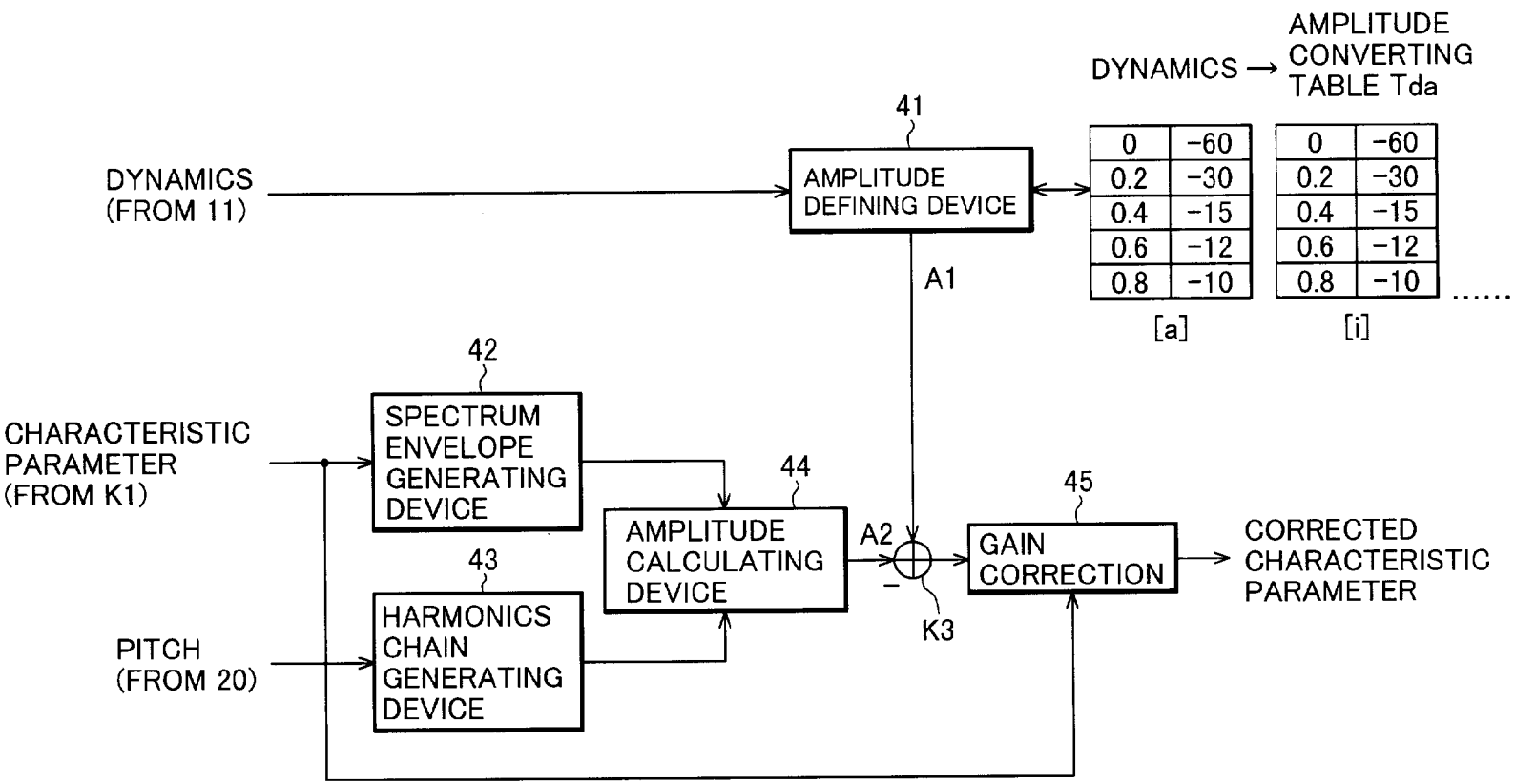
FIG. 3 is a detail of a characteristic parameter correcting unit 21 shown in FIG. 1.

Details of the chacteristic parameter correction unit 21 are explained based on FIG. 3. The chacteristic parameter correction unit 21 equips an amplitude defining unit 41. This amplitude defining unit 41 outputs a desired amplitude value A1 that is corresponding to dynamics information input from the performance data storage unit 11 by referring a dynamics amplitude transformation table Tda.

Also, a spectrum envelope generating unit 42 generates a spectrum envelope based on the characteristic parameter output from the switch SW1.

A harmonics chain generating unit 43 generates a harmonics based on the pitch defined in the pitch defining unit 20. An amplitude calculating unit 44 calculates an amplitude A2 corresponding to the generated spectrum envelope and harmonics. Calculation of the amplitude can be executed, for example, by the inverse FFT and the like.

An adding unit K3 outputs difference between the desired amplitude value A1 defined in the amplitude defining unit 41 and the amplitude value A2 calculated in the amplitude calculating unit 44. A gain correcting unit 45 calculates amount of the amplitude value based on this difference and corrects the characteristic parameter based on the amount of this gain correction. By doing that, a new characteristic parameter matched with desired amplitude.

Further, in FIG. 3, although the amplitude is defined based only on the dynamics with reference to the table Tda, a table for defining the amplitude in accordance with a kind of a phoneme can be used in addition to the table Tda. That is, a table that can output different values of the amplitude when the phonemes are different even if the dynamics are same. Similarly, a table for defining the amplitude in accordance with a frequency in addition to the dynamics can also be used.

Figure 4:
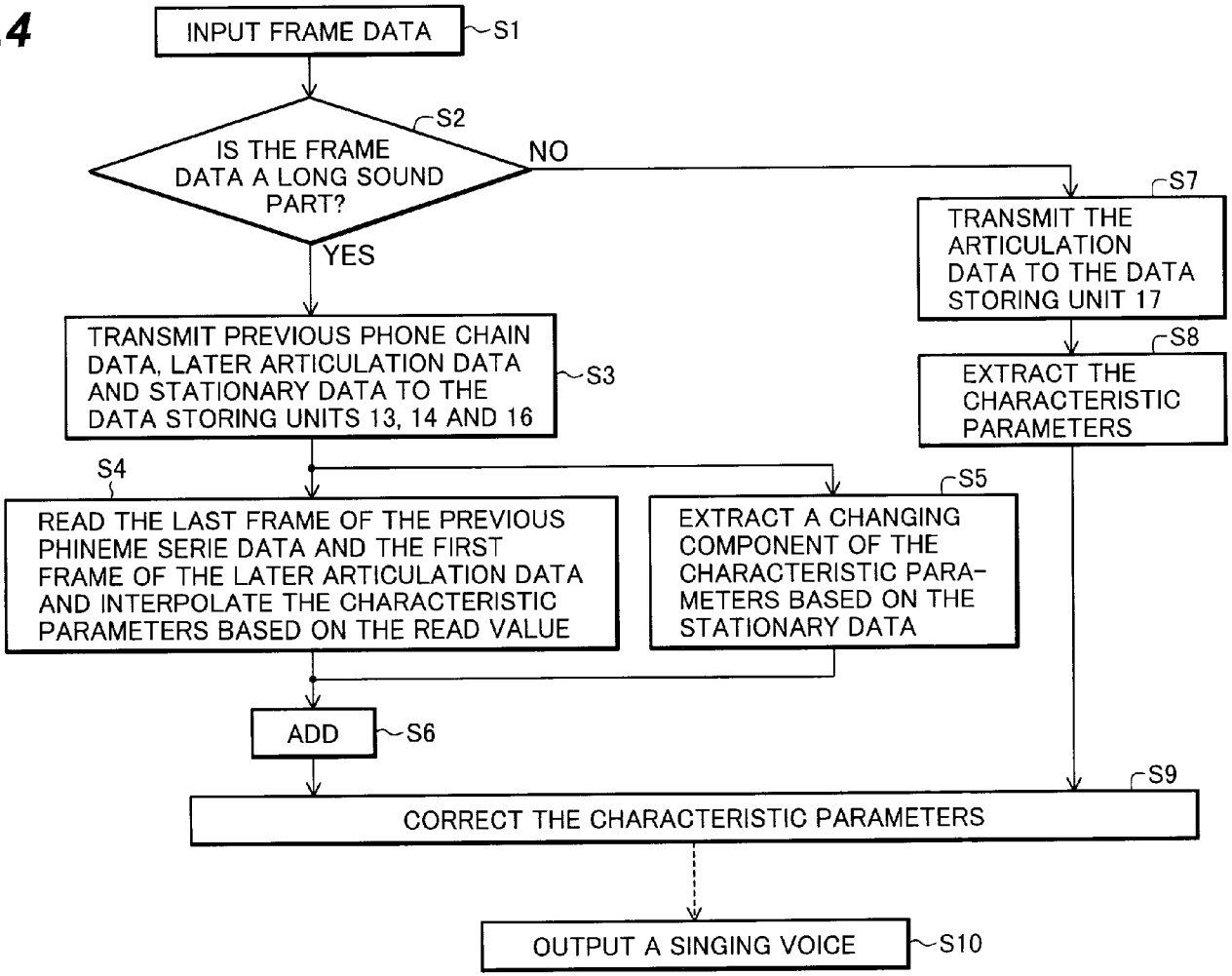
FIG. 4 is a flow chart showing steps of data management in the singing voice synthesizing apparatus according to a first embodiment of the present invention.

Next, an operation of the singing voice synthesizing apparatus according to a first embodiment of the present invention is explained by referring a flow chart shown in FIG. 4.

A performance data storage unit 11 outputs frame data in a time sequential order. A transition part and a long sound part show by turns, processes are different for the transition part and the long sound part.

When frame data is input from the performance data storage unit 11 (S1), it is judged whether the frame data is related to a long sound part or an articulation part in a voice synthesis unit selector 12 (S2). In a case of the long sound part, previous articulation data, later articulation data and stationary data are transmitted to the previous articulation data storage unit 13, the later articulation data storage unit 14 and the articulation data storage unit 16 (S3).

Then, the characteristic parameter interpolation unit 15 picks up the characteristic parameter of the last frame of the previous articulation data stored in the previous articulation data storage unit 13 and the characteristic parameter of the first frame of the last articulation data stored in the later articulation data storage unit 1. Then a characteristic parameter of the long sound prosecuted is generated by linear interpolation of these two characteristic parameters (S4).

Also, the characteristic parameter of the stationary data stored in the stationary data storage unit 16 is provided to the characteristic parameter change detecting unit 18, and a change component of the characteristic parameter of the stationary data is extracted (S5). This change component is added to the characteristic parameter output from the characteristic parameter interpolation unit 15 in the adding unit K1 (S6). This adding value is output to the characteristic parameter correction unit 21 as a characteristic parameter of a long sound via the switch SW1, and correction of the characteristic parameter is executed (S9). On the other hand, the stochastic component of stationary data stored in the stationary data storage unit 16 is provided to the adding unit K2 via the switch SW2.

The spectrum envelope generating unit 23 generates a spectrum envelope for this corrected characteristic parameter. The harmonics amplitude/phase calculating unit 24 calculates an amplitude or a phase of each harmonics generated in the harmonic chain generating unit 22 in accordance with the spectrum envelope generated in the spectrum envelope generating unit 23. This calculated result is output to the adding unit K2 as a chain of parameters (deterministic component) of the prosecuted long sound part.

On the other hand, in the case that the obtained frame data is judged to be a transition part (NO) in Step S2, articulation data of the transition part is stored in the articulation data storing unit 17 (S7).

Next, the frame reading unit 19 reads articulation data stored in the articulation data storage unit 17 as frame data in accordance with a time indicated by a timer 27, and divides into a characteristic parameter and a stochastic component to output. The characteristic parameter is output to the characteristic parameter correction unit 21, and the stochastic component is output to the adding unit K2. This characteristic parameter of the transition part is executed the same process as the characteristic parameter of the above long sound in the chacteristic parameter correction unit 21, the spectrum envelope generating unit 23, the harmonics amplitude/phase calculating unit 24 and the like.

Moreover, the switches SW1 and SW2 switch depending on kinds of prosecuted data. The switch SW1 connects the characteristic parameter correction unit 21 to the adding unit K1 during processing the long sound and connects the chacteristic parameter correction unit 21 to the frame reading unit 19 during processing the transition part. The switch SW2 connects the adding unit K2 to the stationary data storage unit 16 during processing the long sound and connects to the adding unit K2 to the frame reading unit 19 during processing the transition part.

When the transition part, the characteristic parameter of the long sound and the stochastic component are calculated, the added value is processed in the inverse FFT unit 25, and it is overlapped in the overlapping unit 26 to output a final synthesized waveform (S10).

Figure 5A:
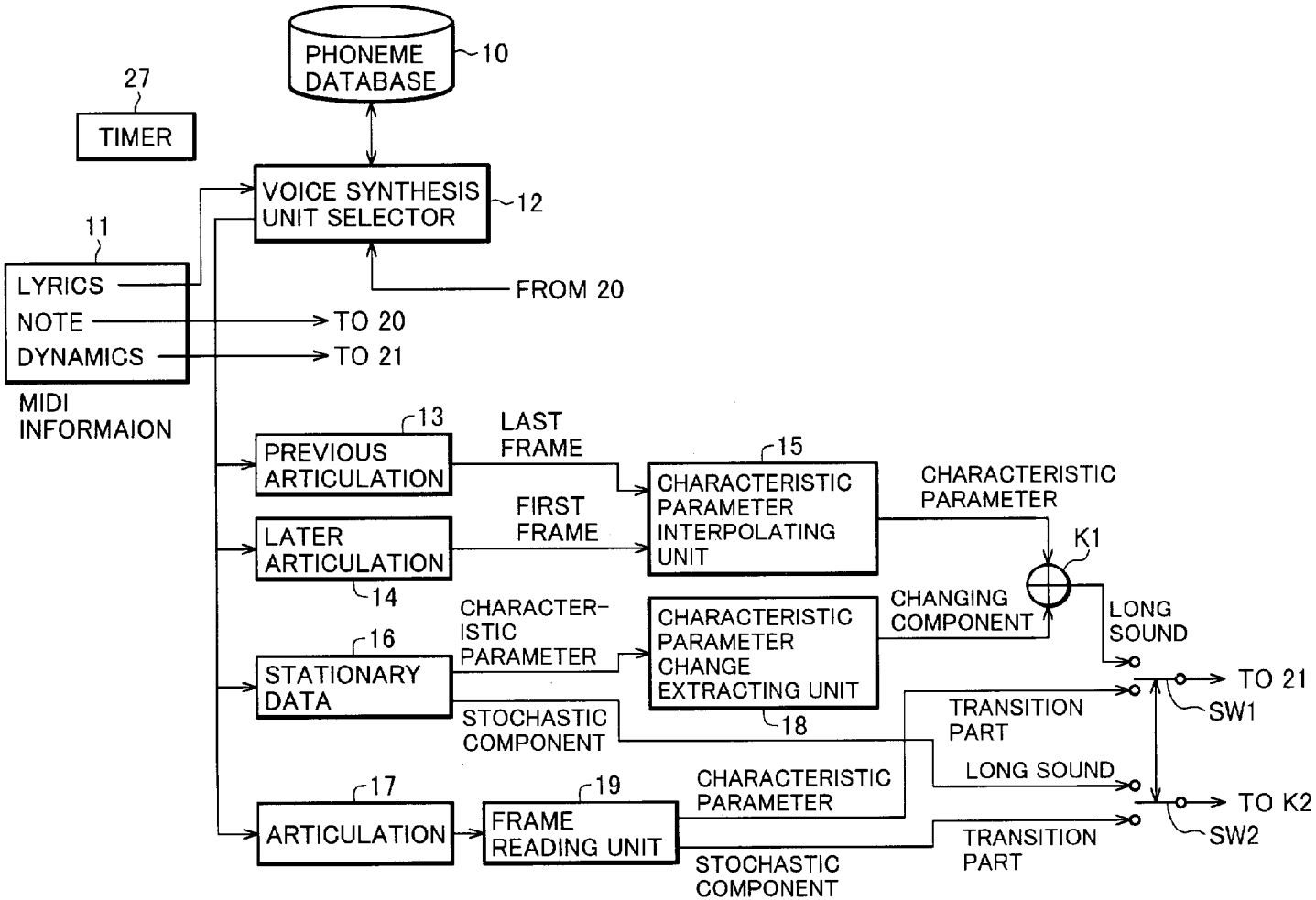
FIGS. 5A to 5C are a functional block diagram of the singing voice synthesizing apparatus and an example of phoneme database according to a second embodiment of the present invention.
Figure 5B:
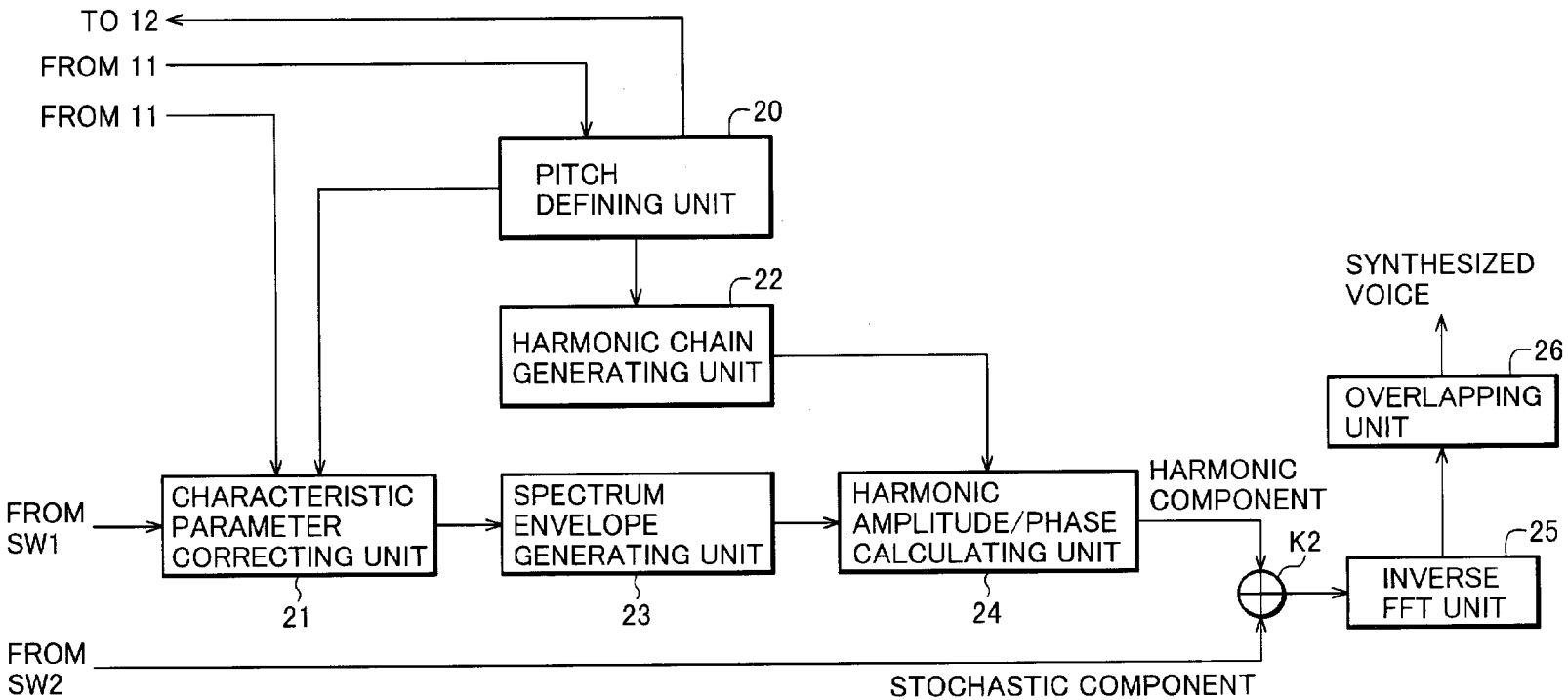
Figure 5C:
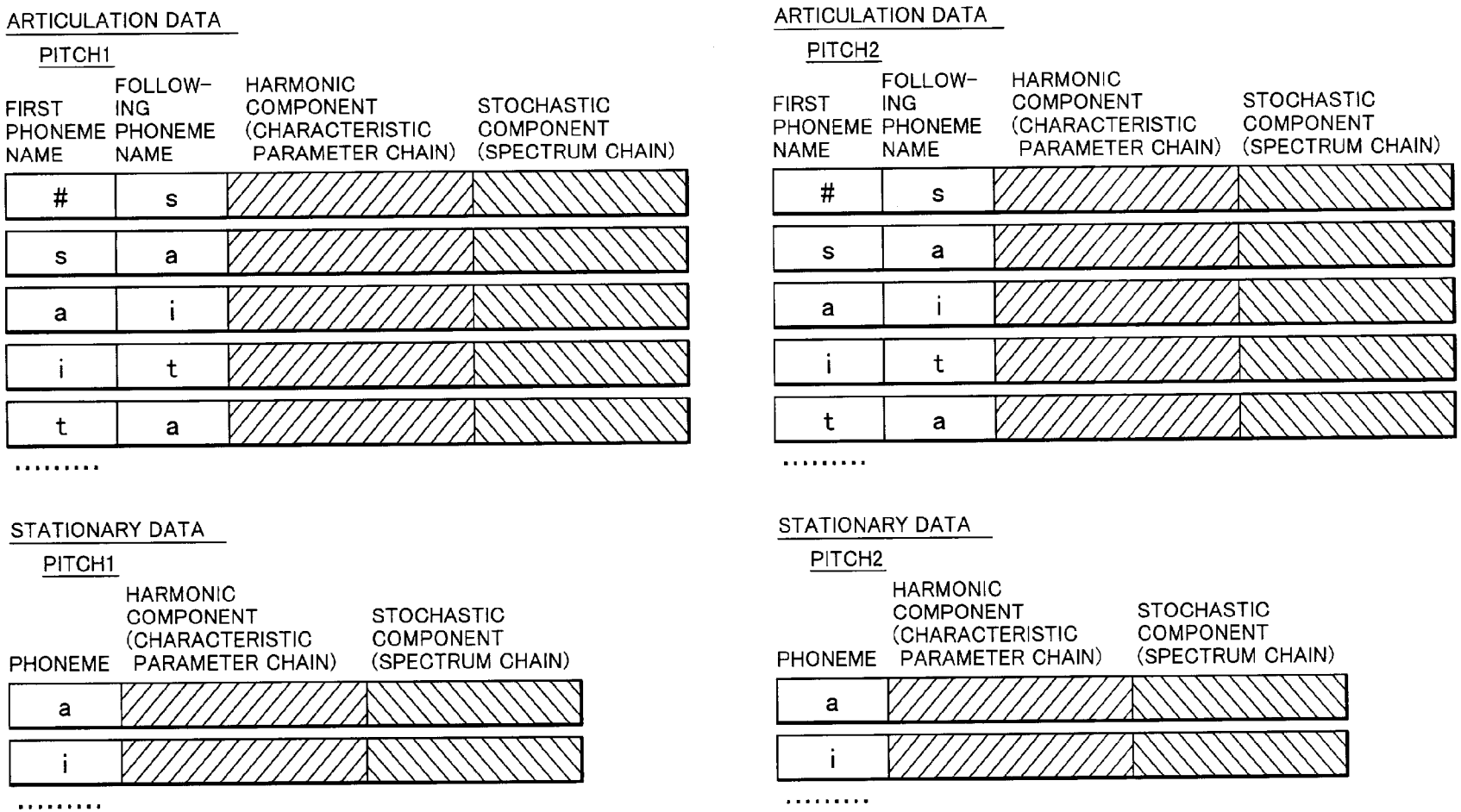

The singing voice synthesizing apparatus according to a second embodiment of the present invention is explained based on FIG. 5. FIGS. 5A to 5C are a block diagram of the singing voice synthesizing apparatus and an example of phoneme database according to the second embodiment. An explanation for the same parts as the first embodiment is omitted by giving the same symbols. One of differences from the first embodiment is that the articulation data and the stationary data stored in the phoneme database are assigned to the characteristic parameters and stochastic component differently in accordance with the pitches.

Also, the pitch defining unit 20 defines pitch based on musical note information in performance data, and outputs the result to the voice synthesis unit selector.

As for an operation of the second embodiment, the pitch defining unit 20 defines pitch of prosecuted frame data based on the musical note from the performance data storage unit 11, and outputs the result to the voice synthesis unit selector 12. The voice synthesis unit selector 12 reads articulation data and stationary data which are the closest to the defined pitch and phoneme information in lyrics information. The later process is the same as that of the first embodiment.

Figure 6A:
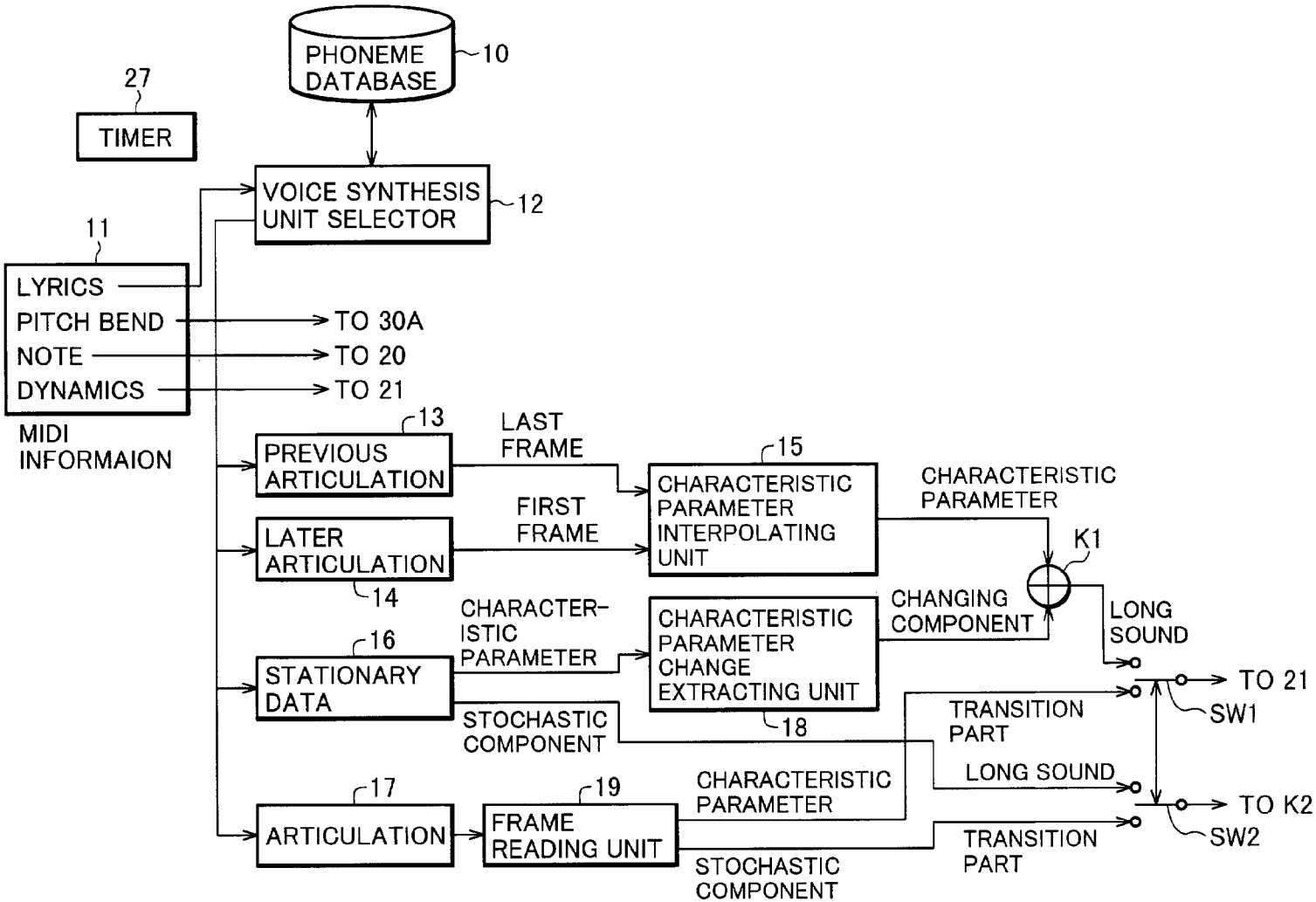
Figure 6B:
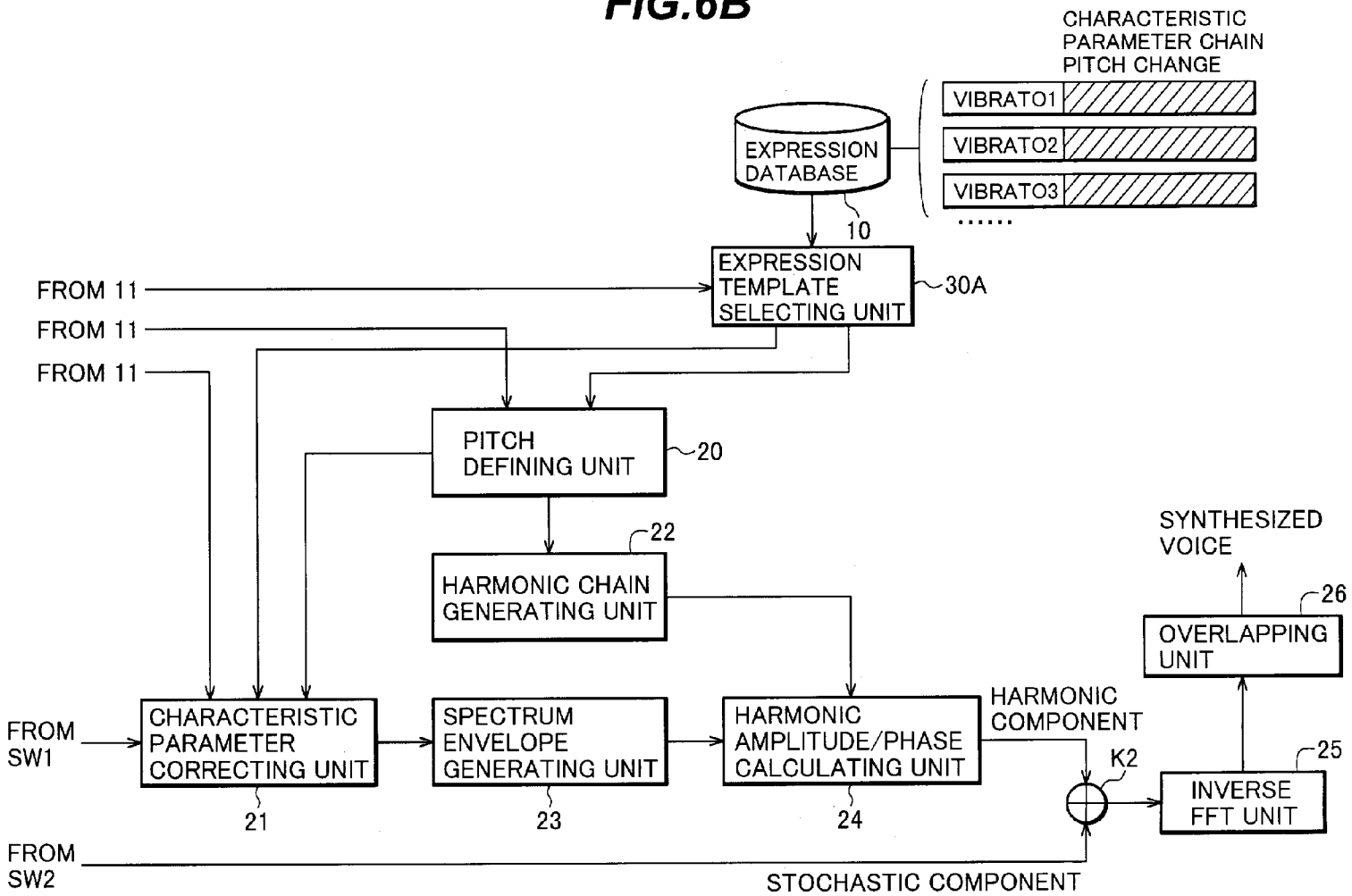
Figure 7:
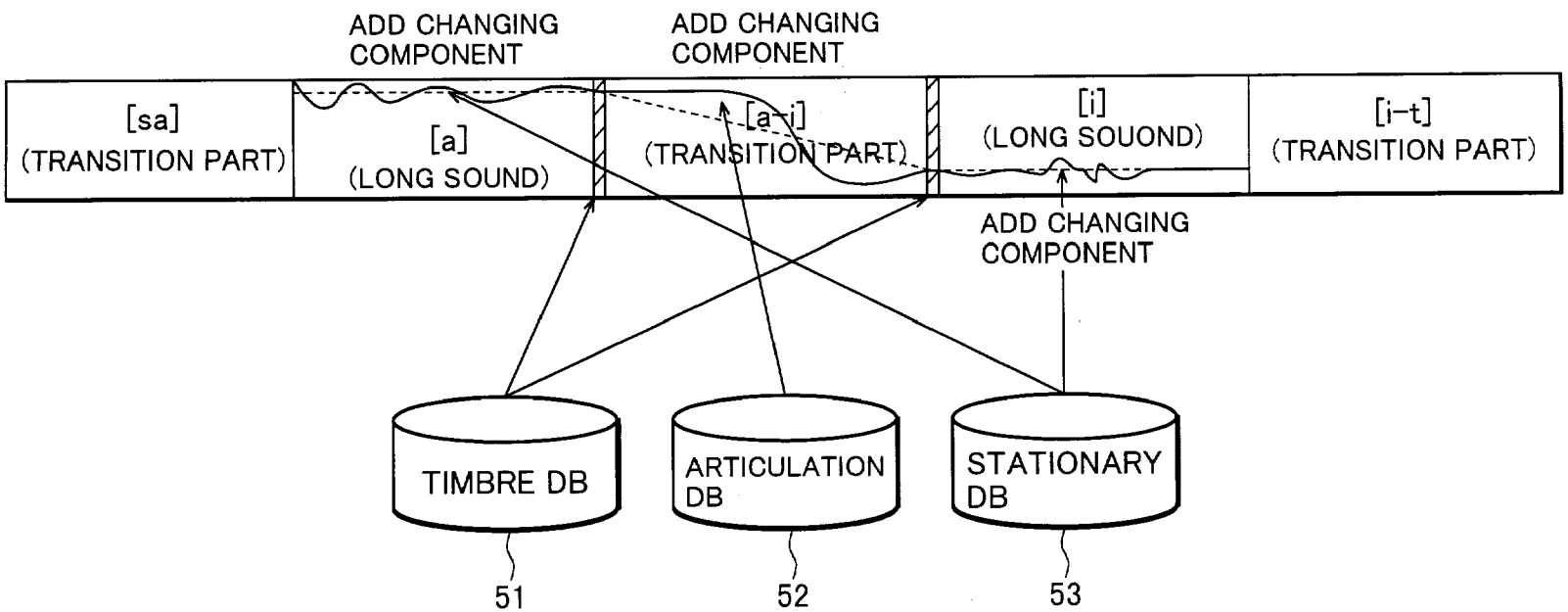
FIG. 7 shows a principle of a singing voice synthesizing apparatus disclosed in Japanese Patent Application No.2001-67258.
Figure 8:
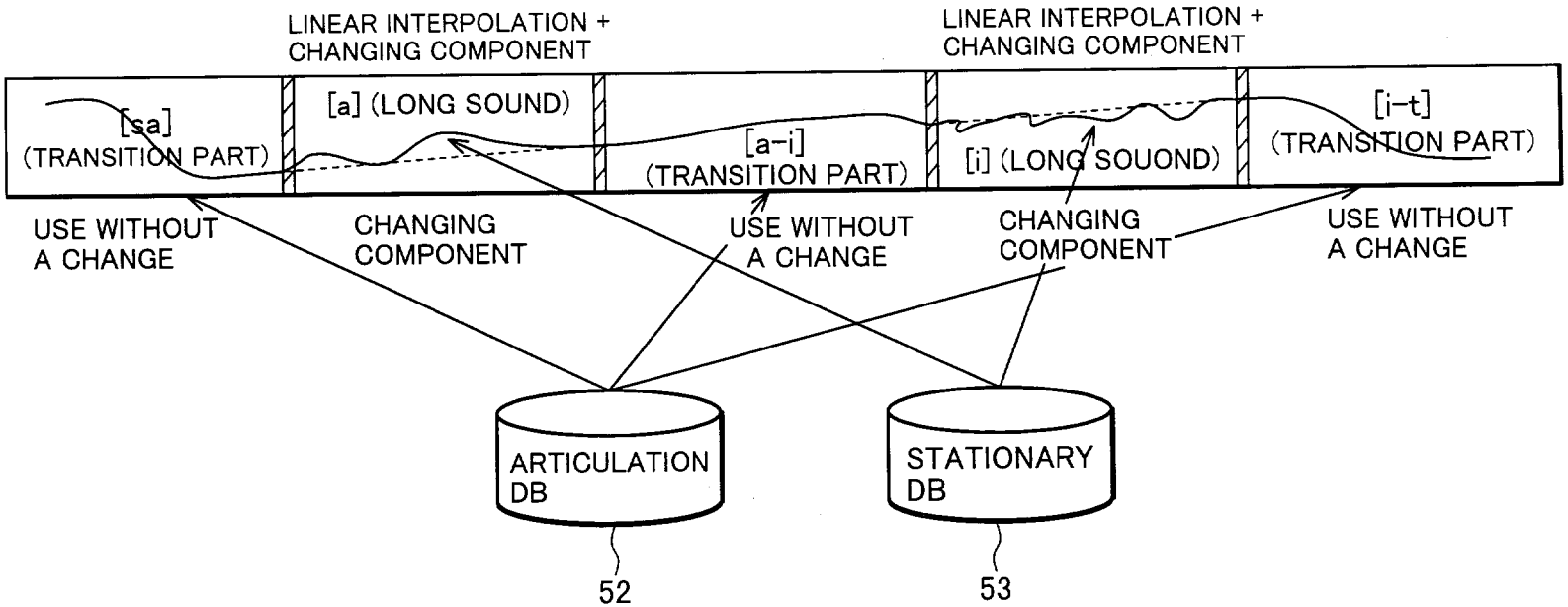
FIG. 8 shows a principle of a singing voice synthesizing apparatus according to the present invention.

The singing voice synthesizing apparatus according to a third embodiment of the present invention is explained based on FIG. 6. FIGS. 6A to 6C are a block diagram of the singing voice synthesizing apparatus and an example of a phoneme database according to the third embodiment. An explanation for the same parts as the first embodiment is omitted by giving the same symbols. One of differences from the first embodiment is that an expression template selector 30A to select an appropriate vibrato template from an expression database is equipped based on an expression database 30 in which vibrato information and the like are stored and expression information in performance data, in addition to the phoneme database 10.

Also, the pitch defining unit 20 defines pitch based on vibrato data from musical note information performance data and the expression template selector 30A.

As for an operation of the third embodiment, reading articulation data and stationary data from the phoneme database 10 in the voice synthesis unit selector 12 is same as the first embodiment based on the musical note from the performance data storage unit 11. The later process is the same as that of the first embodiment.

On the other hand, the expression template selector 30A reads the most suitable vibrato data from the expression database 30 based on expression information from the performance data storage unit 11. Pitch is defined by the pitch defining unit 20 based on the read vibrato data and musical note information in performance data.

The present invention has been described in connection with the preferred embodiments. The invention is not limited only to the above embodiments. It is apparent that various modifications, improvements, combinations, and the like can be made by those skilled in the art.

What is claimed is:

1. A singing voice synthesizing apparatus, comprising:

a storage device that stores singing voice information for synthesizing a singing voice;

a phoneme database that stores articulation data of a transition part that includes an articulation for a transition from one phoneme to another phoneme and stationary data of a long sound part that includes stationary part where one phoneme is stably pronounced;

a selecting device that selects data stored in the phoneme database in accordance with the singing voice information;

a first outputting device that outputs a characteristic parameter of the transition part by extracting the characteristic parameter of the transition part from the articulation data selected by the selecting device; and a second outputting device that obtains the articulation data before and after the stationary data of a long sound part selected by the selecting device, generates a characteristic parameter of the long sound part by interpolating the obtained two articulation data and outputs the generated characteristic parameter of the long sound part.

2. A singing voice synthesizing apparatus according to claim 1, wherein the second outputting device generates the characteristic parameter of the long sound part by adding a changing component of the stationary data to the interpolated articulation data.

3. A singing voice synthesizing apparatus according to claim 1, wherein the articulation data stored in the phoneme database includes a characteristic parameter of the articulation and stochastic component, and the first outputting device further separates the stochastic component.

4. A singing voice synthesizing apparatus according to claim 3, wherein the characteristic parameter of the articulation and the stochastic component are obtained by a SMS analysis of a voice.

5. A singing voice synthesizing apparatus according to claim 1, wherein the stationary data stored in the phoneme database includes a characteristic parameter of the stationary part and stochastic component, and the second outputting device further separates the stochastic component.

6. A singing voice synthesizing apparatus according to claim 5, wherein the characteristic parameter of the articulation and the stochastic component are obtained by a SMS analysis of a voice.

7. A singing voice synthesizing apparatus according to claim 1, wherein the singing voice information includes dynamics information, said apparatus further comprising a correcting device that corrects the characteristic parameters of the transition part and the long sound part in accordance with the dynamics information.

8. A singing voice synthesizing apparatus according to claim 7, wherein the singing voice information further includes pitch information, and the correcting device at least comprises a first calculating device that calculates a first amplitude value corresponding to the dynamics information and a second calculating device that calculates a second amplitude value corresponding to the characteristic parameters of the transition part and the long sound part and the pitch, and corrects the characteristic parameters in accordance with a difference between the first and the second amplitude value.

9. A singing voice synthesizing apparatus according to claim 8, wherein the first calculating device comprises a table storing a relationship between the dynamics information and the amplitude values.

10. A singing voice synthesizing apparatus according to claim 9, wherein the table stores the relationship corresponding to each kind of phoneme.

11. A singing voice synthesizing apparatus according to claim 9, wherein the table stores the relationship corresponding to each frequency.

12. A singing voice synthesizing apparatus according to claim 1, wherein the phoneme database stores the articulation data and the stationary data respectively associated with pitches, and the selecting device stores the characteristic parameters of the same articulation respectively associated pitches and selects the articulation data and the stationary data in accordance with input pitch information.

13. A singing voice synthesizing apparatus according to claim 12, wherein the phoneme database further stores expression data, and the selecting device selects the expression data in accordance with expression information included in the input singing voice information.

14. A singing voice synthesizing method, comprising the steps of:

(a) storing articulation data of a transition part that includes an articulation for a transition from one phoneme to another phoneme and stationary data of a long sound part that includes stationary part where one phoneme is stably pronounced into a phoneme database;

(b) inputting singing voice information for synthesizing a singing voice;

(c) selecting data stored in the phoneme database in accordance with the singing voice information;

(d) outputting a characteristic parameter of the transition part by extracting the characteristic parameter of the transition part from the articulation data selected at step (c); and (e) obtaining the articulation data before and after the stationary data of a long sound part selected at step (c), generating a characteristic parameter of the long sound part by interpolating the obtained two articulation data and outputting the generated characteristic parameter of the long sound part.

15. A singing voice synthesizing method according to claim 14, wherein, in step (e), the characteristic parameter of the long sound part is generated by adding a changing component of the stationary data to the interpolated articulation data.

16. A singing voice synthesizing method according to claim 14, wherein the singing voice information includes dynamics information, the method further comprising the step of (f) correcting the characteristic parameters of the transition part and the long sound part in accordance with the dynamics information.

17. A singing voice synthesizing method according to claim 16, wherein the singing voice information further includes pitch information, and the step (f) at least comprises sub-steps of (f1) calculating a first amplitude value corresponding to the dynamics information and (f2) calculating a second amplitude value corresponding to the characteristic parameters of the transition part and the long sound part and the pitch, and correcting the characteristic parameters in accordance with a difference between the first and the second amplitude value.

18. A machine readable storage medium storing instructions for causing a computer to execute a singing voice synthesizing method comprising the steps of:

(a) storing articulation data of a transition part that includes an articulation for a transition from one phoneme to another phoneme and stationary data of a long sound part that includes stationary part where one phoneme is stably pronounced into a phoneme database;

(b) inputting singing voice information for synthesizing a singing voice;

(c) selecting data stored in the phoneme database in accordance with the singing voice information;

(d) outputting a characteristic parameter of the transition part by extracting the characteristic parameter of the transition part from the articulation data selected at step (c); and (e) obtaining the articulation data before and after the stationary data of a long sound part selected at step (c), generating a characteristic parameter of the long sound part by interpolating the obtained two articulation data and outputting the generated characteristic parameter of the long sound part.

19. A machine readable storage medium according to claim 18, wherein, in step (e), the characteristic parameter of the long sound part is generated by adding a changing component of the stationary data to the interpolated articulation data.

20. A machine readable storage medium according to claim 18, wherein the singing voice information includes dynamics information, said method further comprising the step of (f) correcting the characteristic parameters of the transition part and the long sound part in accordance with the dynamics information.

21. A machine readable storage medium according to claim 20, wherein the singing voice information further includes pitch information, and the step (f) at least comprises sub-steps of (f1) calculating a first amplitude value corresponding to the dynamics information and (f2) calculating a second amplitude value corresponding to the characteristic parameters of the transition part and the long sound part and the pitch, and correcting the characteristic parameters in accordance with a difference between the first and the second amplitude value.

* * * * *